United States Patent [19]

Armbruster

[11] Patent Number: 4,827,274

[45] Date of Patent: May 2, 1989

[54] MOTOR VEHICLE WINDOW PANE

[75] Inventor: Günter Armbruster, Krefeld, Fed. Rep. of Germany

[73] Assignee: Flachglas Aktiengesellschaft, Furth, Fed. Rep. of Germany

[21] Appl. No.: 129,656

[22] Filed: Dec. 7, 1987

[30] Foreign Application Priority Data

Dec. 6, 1986 [DE] Fed. Rep. of Germany ..... 3641738

[51] Int. Cl.[4] ..... H01Q 1/32

[52] U.S. Cl. ..... 343/712

[58] Field of Search ..... 343/711, 712, 713

[56] References Cited

FOREIGN PATENT DOCUMENTS 730131 1/1943 Fed. Rep. of Germany ..... 343/713

2745475 4/1979 Fed. Rep. of Germany ..... 343/713

*Primary Examiner*—William L. Sikes

*Assistant Examiner*—Robert E. Wise

*Attorney, Agent, or Firm*—Herbert Dubno

[57] ABSTRACT

The motor vehicle window pane comprises at least one silicate glass panel, especially a single sheet safety glass, which has a transmission reducing layer (TR-layer) comprising at least one metal, a metal alloy or a metal compound on one free surface. The TR-layer is applied over the entire surface. An insulating layer made of a nonconducting enamel is applied to the TR-layer at the assembly edge strip and is burned in. The insulating layer can be widened relative to an assembly assisting piece so that the assembly assiting piece leaves an inner zone on the window surface free. The TR-layer can now be used as a window pane antenna or can be equipped with antenna conductors which end before reaching the assembly assisting piece.

10 Claims, 1 Drawing Sheet

MOTOR VEHICLE WINDOW PANE

FIELD OF THE INVENTION

My present invention relates to a motor vehicle window pane (especially a windshield or rear window panel) and, more particularly, to a vehicle window pane having at least one silicate glass pane, especially of single-sheet safety glass.

BACKGROUND OF THE INVENTION

A motor vehicle window pane can consist of a silicate glass panel, especially a single sheet safety glass pane, which has a transmission reducing layer (TR-layer) (as an antiglare coating) comprising at least one metal, a metal alloy or a metal compound on a free surface of the pane. The TR-layer is applied over the complete surface and the motor vehicle window pane is insertable in a window opening of a metallic motor vehicle body with a peripheral assembly including a piece interposed in the vicinity of an assembly edge strip of the motor vehicle window pane.

By an "assembly-assisting piece" I mean a frame-like component made of rubber or plastic or a suitably located adhesive piece applied as a bead for assembly in the course of the socalled direct gluing.

My invention is especially related to a motor vehicle window pane which is set up for direct gluing, i.e. permits an adhesive bond between the glass and the vehicle body.

It is also related to other motor vehicle window pane constructions which are assembled as a combined safety glass pane made from unprestressed silicate glass panes.

The invention also may make use of a motor vehicle window pane which is made of single-sheet safety glass or in which a silicate glass pane composed of a single-sheet of safety glass is combined with at least one other silicate glass pane.

Usually these motor vehicle window panes are curved. The TR-layer can be a single layer or a multilayer structure; particularly it can have an additional stabilizing layer. The motor vehicle window pane is inserted in the window opening of the motor vehicle body so that the TR-layer is on the surface of the window pane adjacent the motor vehicle interior.

The TR-layer covers the motor vehicle window pane over its entire surface, i.e. to the edge. The motor vehicle window pane can be made from the factory-produced sheet which is coated over an entire surface, and from which the pane is cut out and after that prestressed and/or otherwise processed.

The motor vehicle window pane described above has been proven in regard to transmission reduction and is widely used. Special requirements are demanded of the TR-layer. The TR-layer must be able to withstand the mechanical stresses and strains and the action of corrosion on the window pane in the assembled state.

It must also bear the stresses and strains on thermal prestressing and/or bending in an oxidizing atmosphere without damage. A motor vehicle window pane has proved to be effective with a TR-layer of a structure as described in German Patent Document Nos. 36 11 844 and 36 28 051. My invention is especially related to a motor vehicle window pane in which the TR-layer is applied as described in these documents.

Up to now the known motor vehicle window pane could not be set up simultaneously as an antenna pane and of course neither directly nor indirectly with antenna conductors made of conductive enamel which are burned or fritted in the usual way. The antenna activity has not been satisfactory either for amplitude modulated radio-frequency waves (i.e. radio-frequency waves of long, middle or short wavelengths) or for frequency modulated radiowaves (i.e. radio waves in the ultrashort region).

The conductors tend to interact with the assembly-assisting piece, especially with the adhesive strip in standard use in direct gluing. Actually the known assembly-assisting piece has a comparatively low electrical high frequency resistance because the assembly-assisting pieces usually have a considerable amount of carbon.

Motor vehicle window panes which are impressed with a conductive layer used as a window antenna or with antenna conductors and are used simultaneously as antennas are known.

However other motor vehicle window panes are also known (compare those described in German Pat. No. 34 10 415, and Japanese Patent Document No. 51-30 905).

A conductive layer is provided but an edge strip running peripherally around the glass window pane remains free of the conductive layer.

Usually one normally separates the antenna element for the long/middle/short regions from that of the ultrashort region which additionally is frequently used also as a heating element.

Satisfactory antenna action has hitherto required a comprehensive analysis making use of the Maxwell equations because the conductive layer and/or the antenna conductor of the motor vehicle glass pane with the motor vehicle body interact together electromagnetically.

This intersection leads to particular geometries and arrangements as well as to special features such as the balancing or coupling to the detected electromagnetic energy and the suppression of interfering influences (compare also with the theoretical explanation in German Pat. No. 34 10 415).

However, knowledge of high frequency radio engineering principles can at least lead to optimization. All these measures however give rise to less than satisfactory results.

OBJECTS OF THE INVENTION

It is an object of my invention to provide an improved motor vehicle window pane which will avoid the aforedescribed drawbacks.

It is also an object of my invention to provide an improved motor vehicle window pane which has a TR-layer covering its entire surface which also extends into an assembly edge strip far enough so that it can be used as an antenna with a better antenna effectiveness.

It is another object of my invention to provide an improved motor vehicle window pane which has a TR-layer covering its entire surface which also extends into an assembly edge strip to permit optimization of the detection of the high frequency electromagnetic energy.

SUMMARY OF THE INVENTION

These objects and others which will become more readily apparent hereinafter are attained in accordance with my invention in a motor vehicle window pane comprising at least one silicate glass panel, especially a single sheet safety glass, which has a transmission reducing layer (TR-layer) comprising at least one metal, a metal alloy or a metal compound on one free surface. The TR-layer is applied ever the entire surface and the motor vehicle window pane is insertable in a window opening of a metallic motor vehicle body with a peripheral assembly-assisting piece interposed in the vicinity of an assembly edge strip of the motor vehicle window pane.

According to the invention an insulating layer of a nonconducting enamel is applied to the TR-layer of the assembly edge strip and burned in and the assembly-assisting piece is put on the insulating layer so that the TR-layer can be used as a window antenna.

The term "burned in" is used herein to describe the conventional step of bonding an enamel to the glass by baking.

The insulating layer can be widened relative to the assembly-assisting piece so that the assembly-assisting piece leaves an inner zone free and at least one connector element or collector bar for the window antenna is located on the inner zone of the insulating layer and is connected electrically with the TR-layer in or next to the insulating layer.

Advantageously, the insulating layer is double layered, being built from a window side base layer and a covering layer. The covering layer can cover if necessary also the connector element or the collector bar on the inner zone of the insulating layer.

A plurality of conductive antenna conductors can be applied to the TR-layer, an insulating layer made of a nonconducting enamel is applied to the TR-layer of the assembly edge strip and is burned in and the assembly-assisting piece is located on the insulating layer.

The assembly-assisting piece can be widened relative to the assembly-assisting piece so that the assembly-assisting piece leaves an inner zone free on the insulating layer and the antenna conductor with an end thereof and/or with the collector bar connected electrically with the antenna conductor is located on the inner zone of the insulating layer.

Also in this case according to a feature of my invention the insulating layer can be if necessary double layered and have a window pane side base layer and a covering layer.

The covering layer can cover the end of the antenna conductor and/or the collector bar located on the base layer of the insulating layer.

The antenna conductor simultaneously can be provided as a heated conductor or heating element for heating the motor vehicle window pane—or the reverse. Of course the conductor devices for the leads coming off are located outside of the vicinity of the assembly-assisting pieces.

It is thus possible to achieve surprisingly good antenna effectiveness for both amplitude modulate radiowaves and also for frequency modulated radiowaves.

When the TR-layer is used as a window antenna the TR-layer can be divided up into fields and strips by a plurality of planes of separation interrupting the electrical connection and because of that can be provided for high frequency applications according to the particular function.

This division can already be achieved by coating during manufacture and by subsequent, particularly linear, coating of the TR-layer.

The TR-layer also assists when additional antenna conductors made of conductive enamel are applied advantageously in regard to high frequency operation. More over no special connector is needed for the TR-layer.

However, according to a feature of the invention the TR-layer is additionally provided as an antenna conductor and with suitable connectors. There are additional switching possibilities in regard to the high frequency applications. The TR-layer can be also provided as a heated conductor or heating element for heating the motor vehicle window pane.

The fact that the motor vehicle window pane according to my invention in regard to high frequency engineering and thus in regard to antenna engineering allows a plurality of possibilities is of special advantage. Hence, the circuits can be used which have been proven effective in high frequency and antenna engineering. Particularly a plurality of motor vehicle window panes according to my invention can be used in a motor vehicle and can be combined in regard to their electronic circuits (diversity-antenna switching).

The TR-layer advantageously comprises a glass-side metal layer including a metal selected from the group consisting of platinum, iridium and rhodium or a mixture thereof as well as a thin stabilizing layer made from a metal oxide selected from the group consisting of an oxide of bismuth, indium, nickel, antimony, tin, tantalum, titanium, zinc or a mixture thereof.

The TR-layer can however be made of a silicide or a metal silicide with a metal of atomic number 22 to 28 and with a silicon content of 45 to 75 atom percent. The TR-layer can be provided with a direct current surface resistance of greater than 20 ohms, advantageously greater than 60 ohm. The insulating layer can have a high frequency resistance of greater than $10^6$ ohm. The TR-layer under the insulating layer has a vanishingly small conductivity. One generally applies these coatings by printing and burning them on.

My invention rests on the surprising determination that an interfering capacitive coupling of the TR-layer to the motor vehicle body is effectively prevented by the burned in insulating layer made of nonconducting enamel. Surprisingly the TR-layer loses its conductivity on burning in the enamel so that it has a vanishingly small conductivity under the insulating layer. The TR-layer interacts chiefly inductively in a high frequency field. A flat current distribution arises in the TR-layer. The pickup appropriately is a low impedence pickup.

Known measures are not sufficient to attain a uniform printing of the antenna conductors made from conductive enamel to effect a sufficient capacitive uncoupling between the motor vehicle body and the antenna conductors in the vicinity of the assembly-assisting piece. Thus in the motor vehicle window pane according to my invention the conductive antenna conductors are positioned outside the assembly-assisting piece.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
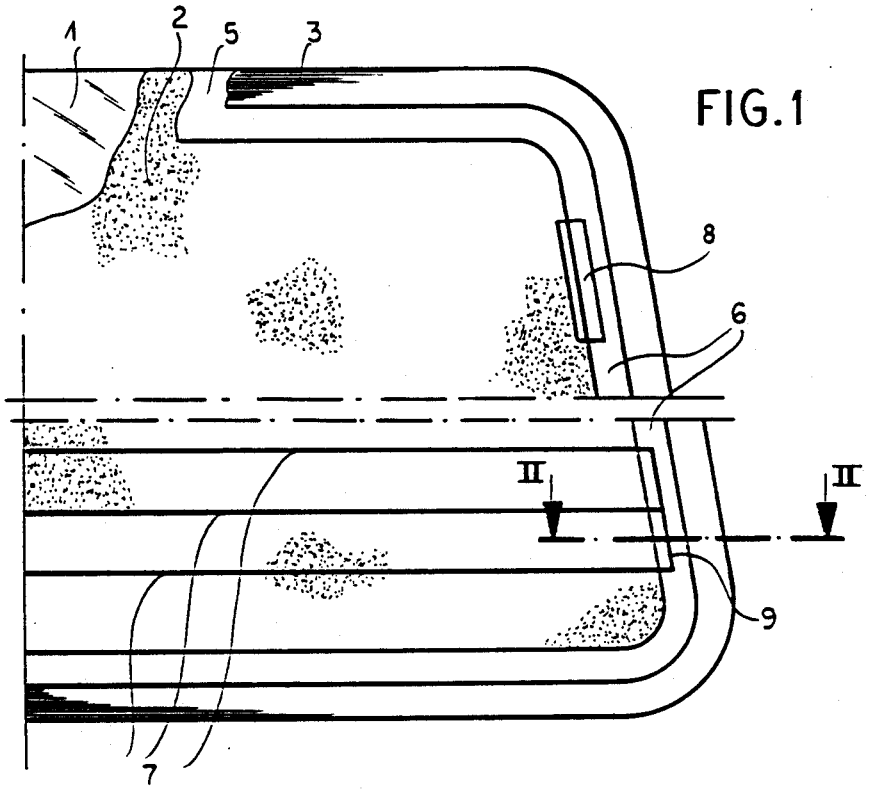
FIG. 1 is an elevational view, partly broken away of a motor window pane according to my invention.

The length and/or width of the conductors and layers has been exaggerated in the drawing to provide a clear indication. That is also true for the strips in the vicinity of the edges.

The motor vehicle window pane 1 shown in the drawing comprises a silicate glass panel and of course is single sheet safety glass.

A transmission reducing layer (TR-layer) 2 composed of at least one metal, metal alloy or metal compound (as described) is located on the surface directed into the motor vehicle interior.

Figure 2:
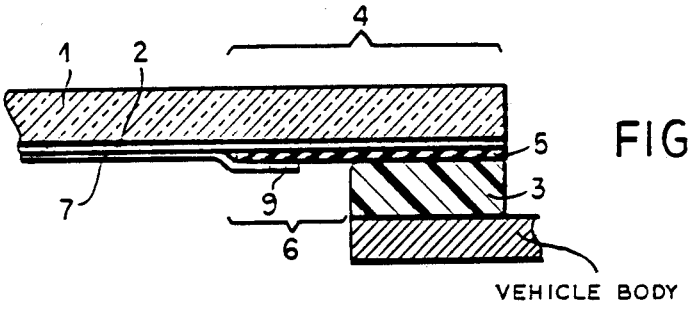
FIG. 2 is a cross sectional view taken along the section line II—II in FIG. 1.
Figure 3:
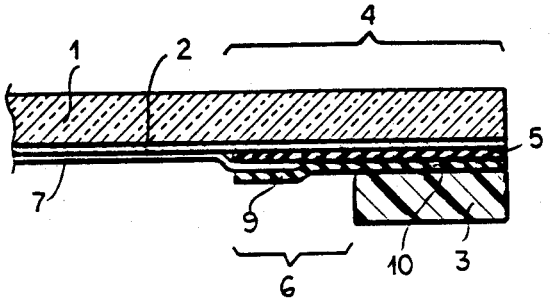
FIG. 3 is a similar cross sectional view of another embodiment.

One sees from FIGS. 2 and 3 that the TR-layer 2 coats the surface completely.

The motor vehicle window panel 1 is insertable or mountable in a window opening of a metallic motor vehicle body with a peripheral assembly-assisting piece 3 interposed in the vicinity of a so-called assembly edge strip 4. The assembly-assisting piece 3 is a portion strip of adhesive in this example.

To allow the TR-layer 2 to act as a window antenna or cooperate with a window antenna an insulating layer 5 made of a nonconductive enamel is applied to the TR-layer 2 of the assembly edge strip 4 and of course burned in.

It is widened in this example relative to the assembly assembly-assisting piece 3. The assembly-assisting piece 3 is applied at the peripheral edge zone of the window pane to the edge zone or lateral region of the insulating layer 5 and leaves an inner zone 6 free. That is also true for the portion of the motor vehicle window pane 1 which is illustrated in the upper part of FIG. 1. There no additional antenna conductor is provided. In the lower portion of the windshield of FIG. 1 additional antenna conductors 7 are provided.

In both cases the inner zone 6 which functions as an optical blending region or a safety edge zone can be omitted. It also improves the electrical conditions.

As illustrated in the upper portion of FIG. 1 a connector element 8 for the window antenna is located on the inner zone 6 of the insulating layer 5 and is electrically connected with the TR-layer next to the insulating layer 5. A cross sectional view is provided essentially through this arrangement as can be seen in FIG. 2.

For the example shown in the upper portion of FIG. 1 the antenna conductors 7 detectable in FIG. 2 are to be identified with the connector element 8.

When conductive antenna conductors 7, e.g. made of conductive enamel, are applied to the TR-layer, the antenna conductors 7 extend to the assembly edge strips 4. They end before the vicinity of the assembly-assisting piece 3. Also here an insulating layer 5 made of a nonconducting enamel is applied to the TR-layer 2 of the assembly edge strip 4 and of course is burned in.

The assembly-assisting piece 3 is applied to a window panel edge side edge zone of the insulating layer 5 and leaves an inner zone 6 free. This is designed so that the antenna conductors 7 with their ends and/or with associated collector bars 9 connected electrically with them are positioned on the inner zone 6 of the insulating layer 5.

FIG. 3 shows that one can work with a two layer insulating layer 5, 10 comprising a window side base layer 5 and a covering layer 10. This is designed so that the covering layer 10 covers the ends of the antenna conductors 7 and/or the collector bars 9 located on the base layer 5 of the insulating layer 5, 10.

One can proceed similarly for the example in the upper portion of FIG. 1.

Each of the antenna conductors 7 in the lower portion of FIG. 1 can simultaneously be provided as a heated conductor or heating element for heating the motor vehicle window pane 1. It is understood that the covering layer 10 has at least one gap so that input or output leads can be connected electrically to the antenna conductor 7 and/or the collector bars 9. In the example according to the lower portion of FIG. 1 the TR-layer 2 can be also provided as an antenna conductor or a heating element for heating the window pane .

Connector elements 8 as illustrated in the upper portion of FIG. 1 are recommended. One must take care of course that the TR-layer 2 has no short circuits with the motor vehicle body at the outer edge.

I claim:

1. A motor vehicle window pane comprising:

a silicate glass panel, especially a single sheet safety glass, with a peripheral assembly edge zone for mounting in a window opening of a motor vehicle body;

a transmission reducing layer of at least one metal, a metal alloy, or a metal compound on one free surface of said panel and optically transmission reducing, said transmission reducing layer being applied over an entire area of said free surface including said zone;

an insulating layer of a nonconducting enamel on said transmission reducing layer in said zone and burned in thereon;

a mounting piece extending peripherally around said panel on said insulating layer and composed of electrically insulating material so that said transmission reducing layer forms a window antenna, said insulating layer being wider than said mounting piece on said transmission reducing layer so that said mounting piece leaves an inner portion of said zone free; and at least one connector element and collector bar for said window antenna located on said inner portion of said insulating layer and connected electrically with said transmission reducing layer at said insulating layer.

2. The motor vehicle window pane defined in claim 1 wherein said insulating layer is double layered comprising a first window side base layer and a second covering layer, said second layer covering at least one of said connector element and said collector bar on said inner zone of said insulating layer.

3. The motor vehicle window pane defined in claim 1, further comprising a plurality of conductive antenna conductors on said transmission reducing layer.

4. The motor vehicle window pane defined in claim 1, further comprising and antenna conductor for heating said pane.

5. The motor vehicle window pane defined in claim 1, further comprising means for connecting said transmission reducing layer to a source of electrical energy to heat said pane.

6. The motor vehicle window pane defined in claim 1 wherein said transmission reducing layer comprises a first glass-side metal layer including a metal selected from the group consisting of platinum, iridium, rhodium and mixtures thereof, and a second stabilizing layer made from an oxide of a metal selected from the group consisting of bismuth, indium, nickel, antimony, tin, tantalum, titanium, zinc and mixtures thereof.

7. The motor vehicle window pane defined in claim 1 wherein said transmission reducing layer comprises a metal with an atomic number of 22 to 28, and has a silicon content of 45 to 75 atom percent.

8. The motor vehicle window pane defined in claim 1 wherein said transmission reducing layer has a direct current surface resistance of greater than 20 ohm.

9. The motor vehicle window pane defined in claim 8 wherein the direct current surface resistance is greater than 60 ohm.

10. The motor vehicle window pane defined in claim 1 wherein said insulating layer has a high frequency resistance of greater than $10^6$ ohm.

* * * * *